US008155371B2

(12) United States Patent
Wu et al.

(10) Patent No.: US 8,155,371 B2
(45) Date of Patent: Apr. 10, 2012

(54) STRUCTURE OF A VOICE COIL ASSEMBLY

(75) Inventors: Jia-Hroung Wu, Chung Ho (TW); Wen-Chi Fu, Hsinchu (TW); Wen-Lan Wu, Kaohsiung (TW); Yi-Ta Tsai, Chang Hua County (TW); Yong-Siang Chen, Taichung County (TW); Hsiu-Hui Chu, Taichung County (TW); Chyau-Wen Jiang, Taichung (TW); Yu-Jung Chen, Tainan (TW)

(73) Assignee: Hsiuping Institute of Technology, Taichung County (TW)

( * ) Notice: Subject to any disclaimer, the term of this patent is extended or adjusted under 35 U.S.C. 154(b) by 1054 days.

(21) Appl. No.: 12/073,747

(22) Filed: Mar. 10, 2008

(65) Prior Publication Data

US 2009/0226027 A1 Sep. 10, 2009

(51) Int. Cl.
*H04R 1/00* (2006.01)
*H04R 25/00* (2006.01)

(52) U.S. Cl. ..... 381/400; 381/412; 381/401; 381/396

(58) Field of Classification Search ..... 381/400, 381/401, 396, 407, 412
See application file for complete search history.

(56) References Cited

U.S. PATENT DOCUMENTS

| | | | | |
|---|---|---|---|---|
| 4,551,849 | A * | 11/1985 | Kasai et al. | 381/86 |
| 6,681,026 | B2 * | 1/2004 | Kam | 381/412 |
| 6,741,721 | B2 * | 5/2004 | Fukawatase et al. | 381/401 |
| 7,283,637 | B2 * | 10/2007 | Suzuki et al. | 381/152 |
| 2005/0180592 | A1 * | 8/2005 | Miura | 381/401 |

* cited by examiner

*Primary Examiner* — Davetta W Goins
*Assistant Examiner* — Phan Le
(74) *Attorney, Agent, or Firm* — Rosenberg, Klein & Lee

(57) ABSTRACT

A structure of a voice coil assembly includes a plate, a top board, suspending arms and fixtures. The plate has a top and two opposite sides. The top board is disposed on the top of the plate. The suspending arms extend from the two sides of the plate and are connected to the fixtures. A pair of resilient sections is provided between the suspending arms and the fixtures. The resilient sections are formed in a curved, arcuate or wavy shape. The suspending arm has a cross-section in a flat shape.

6 Claims, 4 Drawing Sheets

STRUCTURE OF A VOICE COIL ASSEMBLY

BACKGROUND OF THE INVENTION

1. Field of the Invention

The present invention relates to a structure of a voice coil assembly, and more particularly to an upper suspending arm and a lower suspending arm on respective sides of a plate having an resilient section to connect with a fixture, which increases the space for vertical vibration and prevents the plate from vibrating laterally so as to produce the best sound quality.

2. Description of the Prior Art

A conventional loudspeaker has a cylinder electromagnetic transducer, which is too big in size and may cause inconvenience to the user.

As shown in FIG. 4, a conventional voice coil assembly comprises a plate B which is provided with a coil B1 thereon. The coil B1 may be a conducting line with a plurality of winding and patterned on a printed circuit board. The top of the plate B has a top board B2 for a vibrating membrane to be glued thereon. An upper suspending arm B3 and a lower suspending arm B4 extend from respective sides of the plate B and are connected to a fixture B5. Along with magnets (not shown) provided on the front and rear of the plate B, the plate B produces a vibration while the upper suspending arm B3 and the lower suspending arm B4 are suspended in such a way that they can move in a vertical direction.

However, the upper suspending arm B3 and the lower suspending arm B4 are horizontally connected to the fixture B5, thus, the vertical vibration of the plate B are limited to its space and the amplitude of vibration is limited. The plate B may vibrate laterally to collide with the magnets, which downgrades its performance.

SUMMARY OF THE INVENTION

According to the present invention, there is provided a structure of a voice coil assembly comprising a plate, a top board, suspending arms and fixtures, said plate having a top and two opposite sides, said top board being disposed on the top of said plate, said suspending arms extending from the two sides of said plate and being connected to said fixtures, a pair of resilient sections being provided between said suspending arms and said fixtures, and said resilient sections being in a curved shape.

Preferably, said resilient sections are formed in an arc shape.

Preferably, said resilient sections are formed in a continuous wave shape.

Preferably, said suspending arms have a cross-section in a flat shape with its length in a lateral direction and its width in a vertical direction.

Preferably, said suspending arms are upper suspending arms formed on two upper sides of said plate.

Preferably, said suspending arms are lower suspending arms formed on two lower sides of said plate.

It is the primary object of the present invention to provide a structure of a voice coil assembly, which extends a pair of resilient sections from upper suspending arms and lower suspending arms at respective sides to increase the amplitude of vibration and the driven force.

It is another object of the present invention to provide a structure of voice coil assembly, which provides suspending arms having a cross-section in a flat shape with its length in a lateral direction to increase the rigidity of the vibration and to minimize noisy caused from the vibration.

It is a further object of the present invention to provide a structure of voice coil assembly, which provides a top board with various shapes and sizes to match and to glue to a vibrating membrane.

DETAILED DESCRIPTION OF THE PREFERRED EMBODIMENTS

Figure 1:
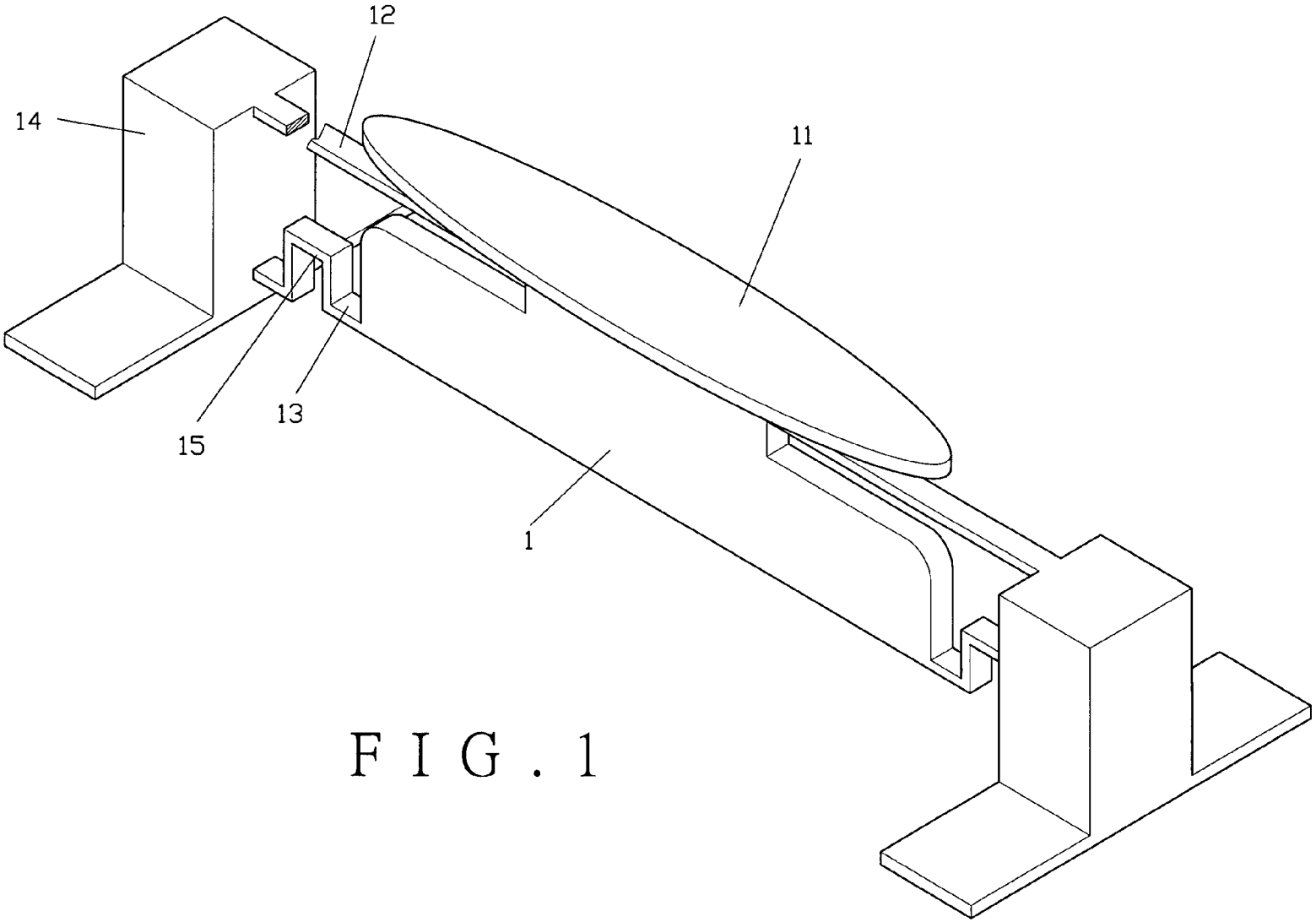
FIG. 1 is a perspective view of a first embodiment of the present invention.

As shown in FIG. 1, a first embodiment of the present invention comprises a plate 1, a top board 11, suspending arms and fixtures 14. The suspending arms comprise a pair of upper suspending arms 12 and a pair of lower suspending arms 13. The plate 1 has a top and two opposite sides. The top board 11 is disposed on the top of the plate 1. The upper suspending arms 12 and the lower suspending arms 13 extend from the two sides of the plate 1 and are connected to the fixtures 14, respectively. A pair of curved resilient sections 15 is provided between the suspending arms (the upper suspending arms 12 and/or the lower suspending arms 13; in this embodiment the lower suspending arms 13 are used as example) and the fixtures 14. The suspending arm (In the drawings, the upper suspending arm 12 is cut) has a cross-section in a flat shape with its length in a lateral direction and its width in a vertical direction.

Figure 2:
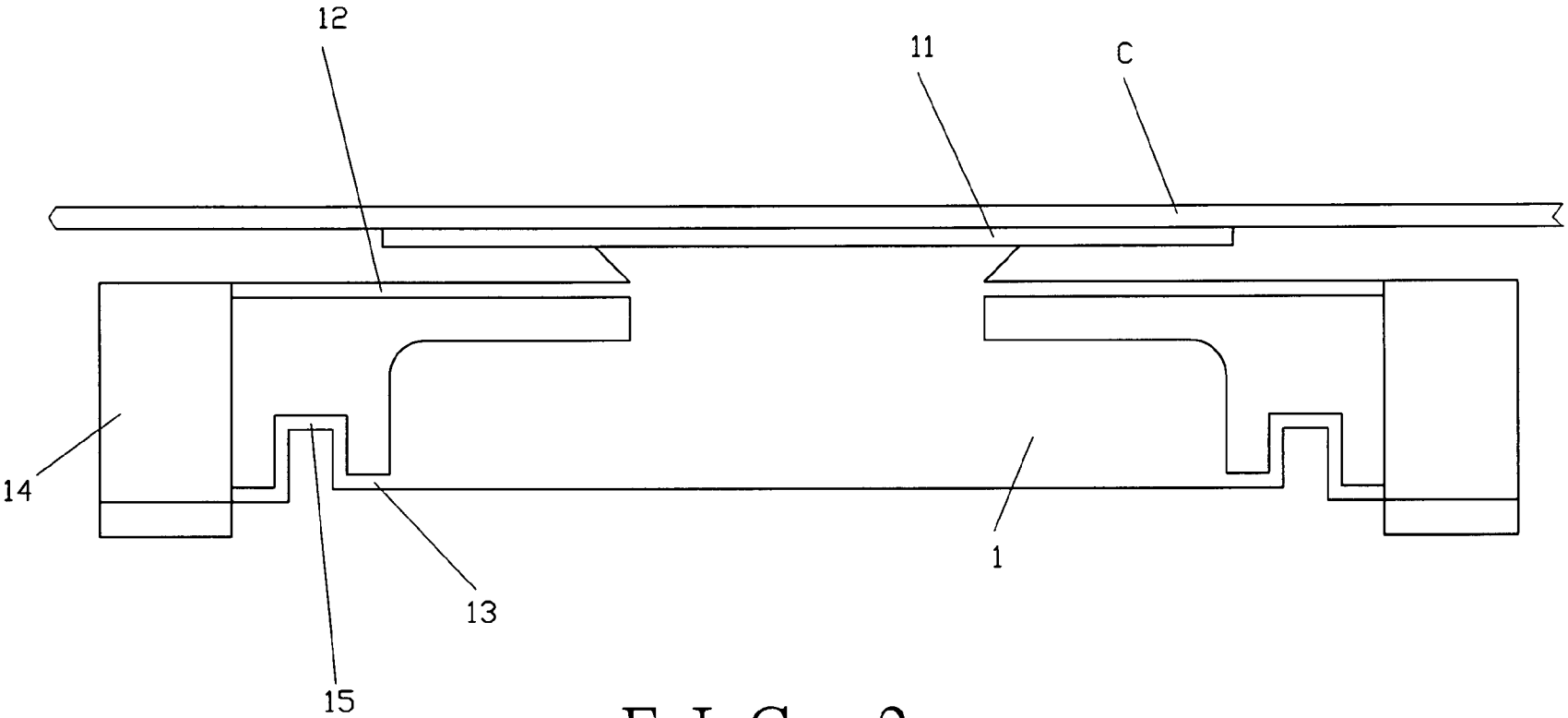
FIG. 2 is a front view of the first embodiment of the present invention showing a vibrating membrane glued to a top board of a plate of the present invention.

To operate the present invention, as shown in FIG. 2, glue a vibrating membrane C to the top board 11 of the plate 1. The shape and size of the top board 11 may be the same as those of the vibrating membrane C which is a rectangle, circle, trapezoid, or polygon.

When the plate 1 vibrates in a vertical direction, the resilient sections 15 between the lower suspending arms 13 and the fixtures 14 provide a larger space for the vibration to lower down the vertical vibrating rigidity of the plate 1, which makes the vertical vibration of the plate 1 easily.

The cross-sections of the upper suspending arms 12 and the lower suspending arms 13 are in a flat shape with the length in the lateral direction and the width in the vertical direction, which increases the vibrating rigidity of the plate 1 in the lateral direction to prevent the plate 1 from vibrating laterally and striking other objects to produce any noises so as to output the best sound quality.

Figure 3:
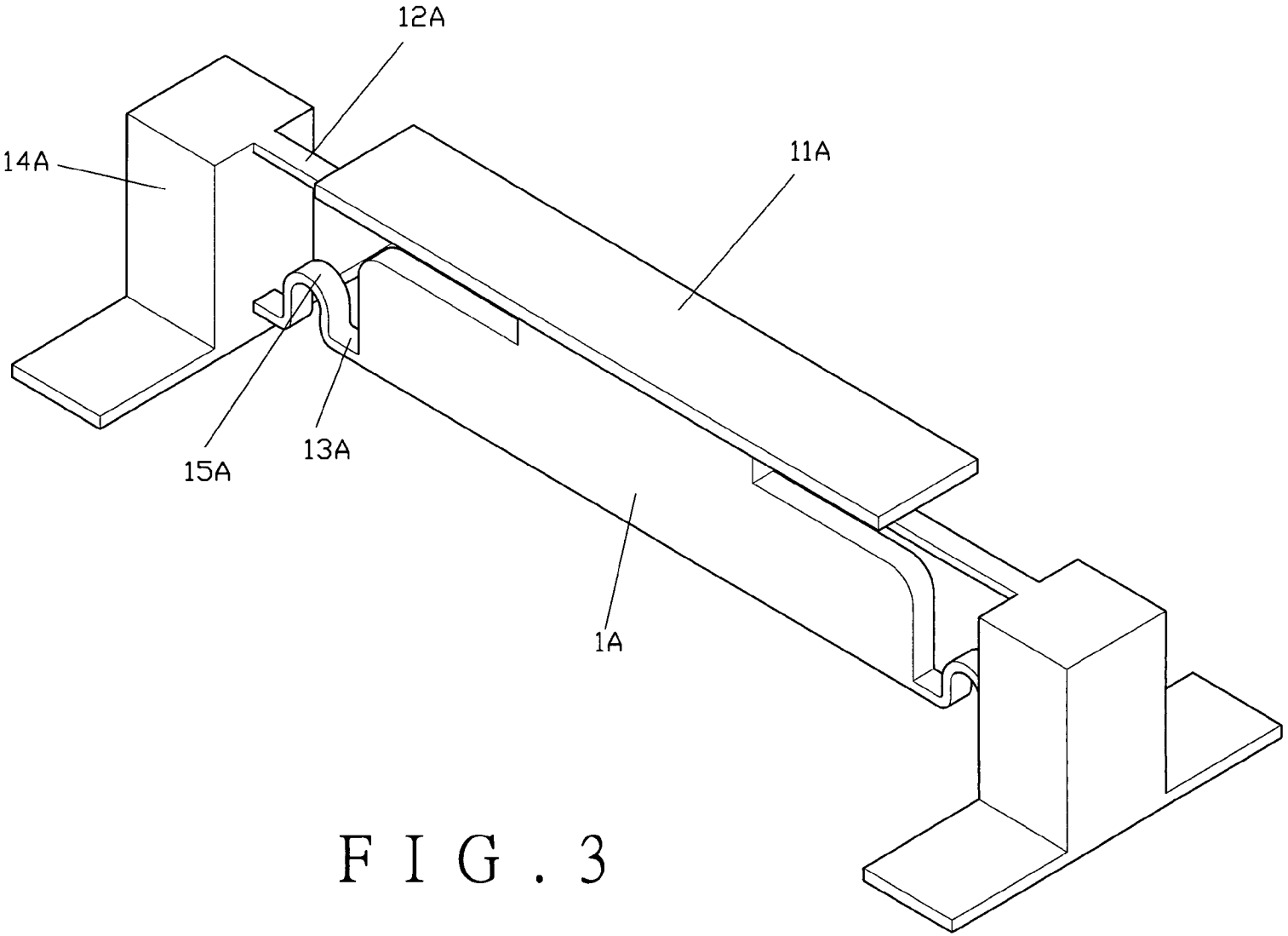
FIG. 3 is a perspective view of a second embodiment of the present invention.
Figure 4:
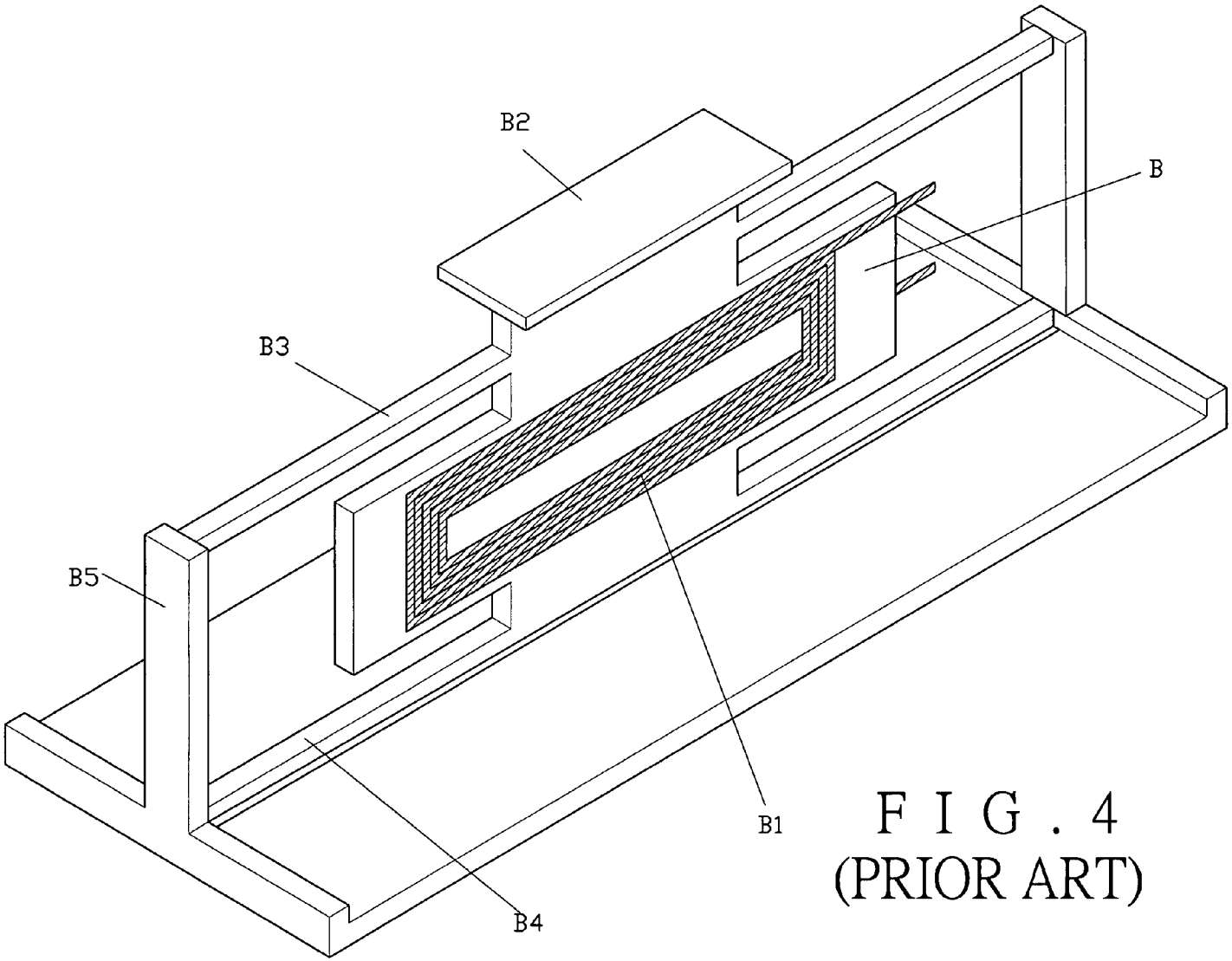
FIG. 4 (PRIOR ART)
FIG. 4 is a perspective view of the prior art.

A second embodiment of the preset invention, as shown in FIG. 3, comprises a plate 1A. A rectangular top board 11A is provided on the top of the plate 1A for being glued to a vibrating membrane in a different shape. When the top board 11A is vibrated, it outputs a smooth audio quality. The plate 1A has its two sides extending suspending arms which comprise a pair of upper suspending arms 12A and a pair of lower suspending arms 13A. The other ends of the upper suspending arms 12A and the lower suspending arms 13A are connected to a pair of fixtures 14A. A pair of resilient sections 15A is provided between the lower suspending arms 13A and the fixtures 14A, and/or between the upper suspending arms 12A and the fixtures 14A. The resilient sections 15A are formed either in an arcuate shape or in a continuous wave shape so that when the plate 1A vibrates vertically, the arcuate resilient sections 15A between the lower suspending arms 13A and the fixtures 14A will provide a space for the vertical vibration and to prevent the plate 1A from vibrating laterally so as to produce the best audio quality.

What is claimed is:

1. A structure of a voice coil assembly comprising:

a plate, a top board, suspending arms and fixtures, said plate having a top and two opposite sides, said top board being disposed on the top of said plate, said suspending arms extending from the two sides of said plate to connect directly to said fixtures, wherein a pair of resilient sections is defined by respective ones of said suspending arms between said plate and said fixtures, and said resilient sections extend in an undulating shape.

2. The structure of a voice coil assembly, as recited in claim 1, wherein said resilient sections are formed in an arc shape.

3. The structure of a voice coil assembly, as recited in claim 1, wherein said resilient sections are formed in a continuous wave shape.

4. The structure of a voice coil assembly, as recited in claim 1, wherein said suspending arms have a cross-section in a flat shape with its length in a lateral direction and its width in a vertical direction.

5. The structure of a voice coil assembly, as recited in claim 1, wherein said suspending arms are upper suspending arms formed on two upper sides of said plate.

6. The structure of a voice coil assembly, as recited in claim 1, wherein said suspending arms are lower suspending arms formed on two lower sides of said plate.

* * * * *